United States Patent [19]

Krügener et al.

[11] 4,237,709

[45] Dec. 9, 1980

[54] LOCKING MECHANISM

[75] Inventors: Rolf Krügener; Ernst Haug; Hermann W. Kurth, all of Sindelfingen, Fed. Rep. of Germany

[73] Assignee: Daimler-Benz Aktiengesellschaft, Fed. Rep. of Germany

[21] Appl. No.: 943,696

[22] Filed: Sep. 19, 1978

[30] Foreign Application Priority Data

Sep. 21, 1977 [DE] Fed. Rep. of Germany ..... 2742467

[51] Int. Cl.[3] ..... E05B 59/00; E05B 63/14

[52] U.S. Cl. ..... 70/107; 70/240; 292/5; 292/8; 292/DIG. 14; 292/DIG. 43

[58] Field of Search ..... 70/240, 107, 108; 292/DIG. 43, DIG. 14, DIG. 37, 5, 8

[56] References Cited

U.S. PATENT DOCUMENTS

| | | | |
|---|---|---|---|
| 2,145,968 | 2/1939 | Bozarth | 292/5 |
| 2,680,639 | 6/1954 | Vigmostad | 292/DIG. 43 X |
| 2,832,620 | 4/1958 | Orlow | 292/DIG. 43 X |
| 4,073,170 | 2/1978 | Miyabayashi et al. | 292/DIG. 43 X |

FOREIGN PATENT DOCUMENTS

| | | | |
|---|---|---|---|
| 2651038 | 5/1978 | Fed. Rep. of Germany | 70/240 |

*Primary Examiner*—William E. Lyddane

*Attorney, Agent, or Firm*—Craig and Antonelli

[57] ABSTRACT

A locking mechanism for lids, hoods, flaps and/or doors, especially in motor vehicles, which cooperates with a cylinder lock whose lock cylinder is provided with a lock part adapted to be pressed-in against the force of a spring. The lock part includes, at its cylindrical outer surface, a pressure pin which is swung by rotation from an operating position to a non-operating position. In addition to the pressure pin, a lug is arranged at the outer surface of the lock part adapted to be pressed-in. The lug is operatively connected with an additional locking mechanism in such a manner that the additional locking mechanism becomes operable only over a limited rotary range of the lock cylinder adjoining the inoperable position of the pressure pin as viewed in the locking direction.

14 Claims, 2 Drawing Figures

LOCKING MECHANISM

Figure 1:
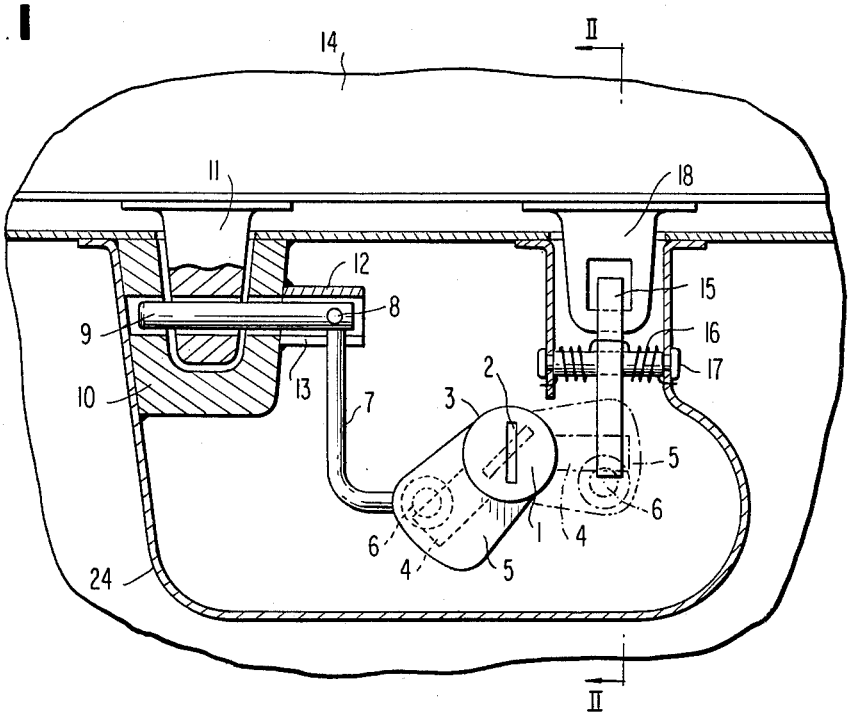

The present invention relates to a locking mechanism for lids, hoods, flaps, and/or doors, especially in motor vehicles, which cooperates with a cylinder lock whose lock cylinder is provided with a lock part adapted to be pressed-in against the force of a spring, which lock part includes at its cylindrical outer surface a pressure pin which is swung by rotation from its operating position into a non-operating position.

Motor vehicles, in the luggage spaces of which valuables are to be transported, must include for purposes of achieving a theft protection for these valuables, in addition to the series-type locking mechanism of the luggage space, an additional locking mechanism. This takes place at present, for example, by means of a vacuum-actuated central locking mechanism, to which are connected the vehicle doors, the tank lock and the luggage space or by means of a locking mechanism which can be actuated only by way of at least one additionally provided lock cylinder.

The present invention is therefore concerned with the task to provide an operationally reliable additional locking mechanism by the use of simple means from a structural and manufacturing point of view, which can be added and incorporated in a simple manner to already existing locking mechanisms so that a vehicle secured in this manner cannot be recognized from the outside under any circumstances.

This is attainable according to the present invention in that, in addition to the pressure pin, a lug is arranged at the outer surface of the lock part adapted to be pressed-in, which is operatively connected with an additional locking mechanism that becomes operable only over a limited lock-cylinder rotational range adjoining the inoperable position of the pressure pin—as viewed in the locking direction.

According to a further feature of the present invention, the position permitting an opening of the lid or the like can be brought about only by rotation of the key in the lock cylinder against the force of a spring.

In a preferred embodiment of the present invention, the additional locking mechanism assists the series-type locking mechanism in its key-actuated locking position.

The construction according to the present invention is characterized in that the additional locking mechanism includes a cranked lever which is operatively connected, on the one hand, by way of a ball joint with the lug and, on the other hand, is pivotally connected with a locking bolt which engages in a lock mounting having a coordinated locking part.

Finally, it is advantageous that the additional locking mechanism and the series-type locking mechanism are accommodated in a common theft-proof housing which is covered off by the outer sheet metal body paneling.

Accordingly, it is an object of the present invention to provide a locking mechanism which avoids by simple means the aforementioned shortcomings and drawbacks encountered in the prior art.

Another object of the present invention resides in a locking mechanism which is simple in construction, minimizes the parts required therefor and can be actuated by way of the lock cylinder used for the series-type locking mechanism.

A further object of the present invention resides in a locking mechanism providing a theft protection by an additional lock which cannot be recognized from the outside of the vehicle.

A still further object of the present invention resides in a locking mechanism for lids, hoods, flaps and/or doors in motor vehicles, which assures an operationally reliable additional locking action by the use of means which are simple both from a structural and manufacturing point of view.

Another object of the present invention resides in an additional locking mechanism of the type described above which can be readily added to already existing locking mechanisms.

Figure 2:
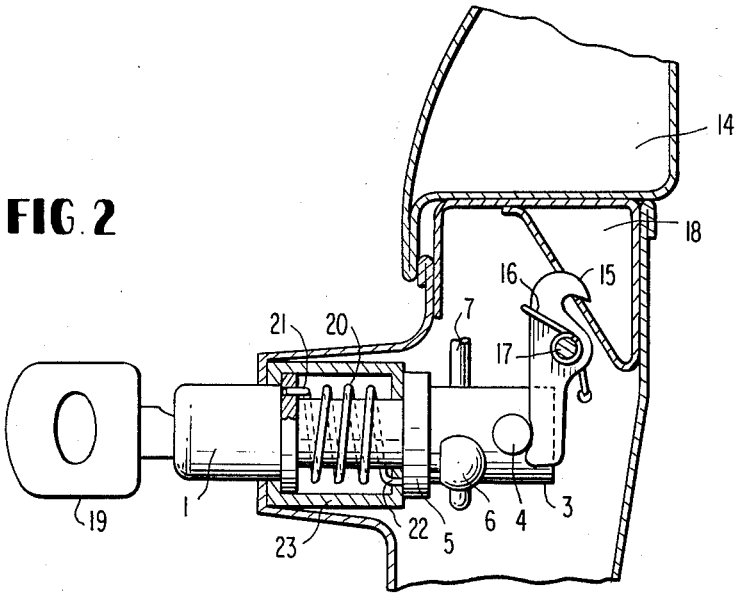

These and other objects, features and advantages of the present invention will become more apparent from the following description when taken in connection with the accompanying drawing which shows, for purposes of illustration only, one embodiment in accordance with the present invention, and wherein:

FIG. 1 is a cross-sectional view through a locking mechanism in accordance with the present invention in the closed and additionally locked position, for example, for a luggage space lid; and FIG. 2 is a cross-sectional view taken along line II—II in FIG. 1, whereby the lock cylinder with pressure pin and lug is rotated into the position illustrated in dash lines in FIG. 1.

Referring now to the drawing wherein like reference numerals are used throughout the two views to designate like parts, FIG. 1 illustrates a spring-loaded lock cylinder 1 constructed as lock part adapted to be pressed-in and known as such, whose key channel 2 is in the vertical position, i.e. at a zero degree rotational angle. A lug 5 is arranged at the outer surface 3 of the lock cylinder 1 which is provided with a pressure pin 4 that already exists in the series-type construction. A ball joint 6 and, following the same, a lever 7 are secured at the lug 5, whereby the lever 7 is pivotally connected at 8 with a latching bolt 9. The latching bolt 9 displaceably engages into the bores of a U-shaped lock mounting 10 having a coordinated locking part 11 secured to the lid 14, and is additionally supported in a tubular guide member 12 provided with a slot 13, in which the lever 7 can move about the pivot point 8 during the displacement of the bolt 9.

The series-type locking mechanism, for example, of a luggage space lid 14, consists—as shown in FIGS. 1 and 2—of a detent hook 15 which is retained in a vertical position pivotal about a shaft 17 by the force of a spring 16 and thereby engages with its detent nose in a locking part 18 of the luggage space lid 14.

In order to open the luggage space, one rotates the lock cylinder 1 together with the pressure pin 4 and the lug 5 by means of the key 19 in the key channel 2 through an angle of rotation of altogether 135° in the counterclockwise direction into the position illustrated in dash lines in FIG. 1, whereby after reaching an angle of rotation of 90°, the latch bolt 9 is freed from the lock part 11 and subsequently during the further rotation of the key 19 through the remaining 45° of the lock cylinder 1 against the force of a spring which then becomes effective and which, for example, may be the spring 20 effecting a return of the pressed-in lock cylinder 1, is transferred into the opening position. In this opening position, the lock cylinder 1 can be pressed-in against the force of the spring 20 whereby the detent hook 15 is pivoted out of the locking part 18 by way of the pressure pin 4 so that the luggage space lid 14 can be opened.

In order to obtain the return force which acts axially for the pressing-in of the lock cylinder 1 and also the return force which acts radially for the rotation of the same lock cylinder, the two ends 21 and 22 of the spring 20 are so retained at a collar of the lock cylinder 1 and at the lock part 23 that, as viewed in the opening direction, a rotation of the spring 20 starts only after an angle of rotation of 90°.

The opening position described hereinabove can therefore be brought about manually only by rotation of the key 19 in the lock cylinder 1 through 135°, whereby the lock cylinder 1 does not remain in this position, but after the opening of the luggage space lid 14 is returned in the clockwise direction by the spring 20 through an angle of rotation of 45° as soon as the key 19 is no longer held fast. This pre-locked position of the lock cylinder 1 corresponds to an angle of rotation of 90° of the key channel 2. Starting from this position, after the closing of the luggage space lid 14 and rotation of the key 19 in the lock cylinder 1 in the clockwise direction from 90° to 0°, the locking position illustrated in FIG. 1 is again attained by the series-type locking mechanism and by the additional locking mechanism according to the present invention.

It is assured in an advantageous manner by the construction of a locking mechanism in accordance with the present invention as described hereinabove that both the series-type locking mechanism as also the additional locking mechanism can be actuated by means of only one lock cylinder. Both locking mechanisms are thereby accommodated in a common theft-proof housing 24 which is additionally covered off by the outer sheet metal cover panel of the body whereby this additional locking mechanism cannot be recognized from the outside.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A locking mechanism for a part to be locked such as a lid, hood, flap and/or door, the locking mechanism being cooperable with a cylinder lock having a displaceably mounted lock cylinder means and spring means operatively effective on the lock cylinder means, the lock cylinder means is adapted to be pressed-in against the force of the spring means, said lock cylinder means including a cylindrical outer surface having a pressure pin, said lock cylinder means being rotatably mounted so as to enable the pressure pin to be swung from an operating position to a non-operating position, characterized in that additional locking means are provided, a lug means is arranged at the outer surface of said lock cylinder means and is operatively connected with said additional locking means, said lug means being arranged at the outer surface with respect to the pressure pin such that said additional locking means becomes operable only over a limited rotary range of the lock-cylinder means, as viewed in a locking direction, adjoins the non-operating position of the pressure pin.

2. A locking mechanism according to claim 1, characterized in that only a rotation of a key in the lock cylinder means against the force of the spring means enables the lock cylinder means to reach a position permitting an opening of the part to be locked.

3. A locking mechanism which includes a series-type locking means according to claim 2, characterized in that the lock cylinder means is operatively connected to the series-type locking means, and in that the additional locking means assists the series-type locking means in locking the part to be locked when the lock cylinder means is in a locked position.

4. A locking mechanism according to claim 3, characterized in that the additional locking means includes a cranked lever, a ball joint means for operatively connecting one end of the cranked lever with the lug means, and in that means are provided for pivotally connecting a second end with a latch bolt which displaceably engages in a lock mounting means having a coordinated locking part.

5. A locking mechanism according to claim 4, characterized in that a common theft-proof housing means covered off externally by a body sheet metal paneling is provided for accommodating the additional locking means and the series-type locking means.

6. A locking mechanism according to claim 2, characterized in that means are provided for mounting said spring means so as to enable the lock cylinder means to be rotated through a predetermined angle of rotation without the lock cylinder means encountering the spring force of said spring means.

7. A locking mechanism according to claim 6, characterized in that said mounting means for said spring means includes a collar means provided on the lock cylinder means for retaining a first end of said spring means, and a lock part disposed at the lock cylinder means for retaining a second end of the spring means.

8. A locking mechanism according to claim 7, characterized in that the predetermined angle of rotation is equal to about 90 °.

9. A locking mechanism according to one of claims 6, 7, or 8, characterized in that the additional locking means includes a cranked lever, a ball joint means for operatively connecting one end of the cranked lever with the lug means, and in that means are provided for pivotally connecting a second end with a latch bolt which displaceably engages in a lock mounting means having a coordinated locking part.

10. A locking mechanism according to claim 9, characterized in that a common theft-proof housing means covered off externally by a body sheet metal paneling is provided for accommodating the additional locking means and the series-type locking means.

11. A locking mechanism according to claim 10, characterized in that the lock cylinder means is operatively connected to the series-type locking means, and in that the additional locking means assists the series-type locking means in locking the part to be locked when the lock cylinder means is in a locked position.

12. A locking mechanism which includes a series-type locking means according to claim 1, characterized in that the lock cylinder means is operatively connected to the series-type locking means, and in that the additional locking means assists the series-type locking means in locking the part to be locked when the lock cylinder means is in a locked position.

13. A locking mechanism according to claim 12, characterized in that a common theft-proof housing means covered off externally by a body sheet metal paneling is provided for accommodating the additional locking means and the series-type locking means.

14. A locking mechanism according to claim 1, characterized in that the additional locking means includes a cranked lever, a ball joint means for operatively connecting one end of the cranked lever with the lug means, and in that means are provided for pivotally connecting a second end with a latch bolt which displaceably engages in a lock mounting means having a coordinated locking part.

* * * * *